United States Patent [19]

Burns

[11] Patent Number: 4,833,897

[45] Date of Patent: May 30, 1989

[54] SALT-FREE LIQUID ICE MANUFACTURING APPARATUS

[75] Inventor: Daniel E. Burns, Camarillo, Calif.

[73] Assignee: Demco, Inc., Oxnard, Calif.

[21] Appl. No.: 369,239

[22] Filed: Apr. 16, 1982

[51] Int. Cl.[4] ..... F25C 5/00

[52] U.S. Cl. ..... 62/330; 366/137

[58] Field of Search ..... 366/136, 137, 245, 247, 366/249, 279, 326, 327; 62/330, 59, 340

[56] References Cited

U.S. PATENT DOCUMENTS

| | | | |
|---|---|---|---|
| 195,803 | 10/1877 | Clous | 366/326 X |
| 561,744 | 6/1896 | Witmer | 366/279 X |
| 1,235,658 | 8/1917 | Connor | 366/249 |
| 2,685,499 | 8/1954 | Hood | 366/137 X |
| 3,166,303 | 1/1965 | Chapman | 366/327 X |
| 3,329,410 | 7/1967 | Rothert | 366/326 |
| 3,734,469 | 5/1973 | Goldstein et al. | 366/327 |
| 4,249,388 | 2/1981 | Burns | 62/330 X |

FOREIGN PATENT DOCUMENTS

| | | | |
|---|---|---|---|
| 6514106 | 6/1966 | Netherlands | 366/249 |

*Primary Examiner*—William E. Tapolcai

*Attorney, Agent, or Firm*—Kelly, Bauersfeld & Lowry

[57] ABSTRACT

The apparatus comprises an enclosure for receiving ice chips and water and a specially designed and dimensioned mixer in the form of a vertical shaft passing into the enclosure and supporting two sets of four turbine blades each. Further, the interior of the enclosure includes baffles spaced radially inwardly from the interior wall to leave a small gap between the wall and each baffle. The resulting violent agitation enables the provision of "liquid ice" without any necessity to add salt as has been required in the past.

4 Claims, 2 Drawing Sheets

SALT-FREE LIQUID ICE MANUFACTURING APPARATUS

FIELD OF THE INVENTION

This invention relates generally to mixer tanks for providing liquid ice for the cooling of vegetables and the like and more particularly to an improved tank or enclosure structure and mixer blades for providing salt free liquid ice.

BACKGROUND OF THE INVENTION

"Liquid ice" comprises a slurry of ice and water, the water serving as a carrier for ground-up or pulverized ice. The slurry is normally provided with a small amount of salt for "lubricating" purposes. In other words, the addition of the salt enhances the "flow" characteristics of the liquid ice so that it is easier to cause penetration by the liquid ice into various areas to be cooled. For example, liquid ice is often used to refrigerate vegetables brought in from the fields in cartons. The added salt at a maximum normally would not exceed ½% of the total volume of ice and water. The ice and water mixture itself normally consists of 37% ice and the remaining 63% water. An example of a liquid ice system particularly useful for refrigerating poultry and fish as well as vegetables is shown in my U.S. Pat. No. 4,249,388 issued Feb. 10, 1981.

Use of salt while providing the desired lubrication for the liquid ice, can be very injurious to any type of machinery coming into contact with the liquid ice, simply from a corrosion standpoint. For example, truck floors made of aluminum have been seriously damaged and corroded by salt in the liquid ice where the ice has been used to cool vegetables and the like while being transported in such trucks.

Another disadvantage of the use of salt is that it is costly even though a relatively small amount is used.

In view of the foregoing, it would be very desirable if liquid ice could be manufactured without using any salt at all. Not only would the corrosion problems be solved, but the liquid ice itself could be more economically produced.

BRIEF DESCRIPTION OF THE PRESENT INVENTION

With the foregoing considerations in mind, the present invention contemplates a greatly improved manufacturing apparatus for providing liquid ice wherein the liquid ice itself is salt-free.

More particularly, in its broadest aspect, the present apparatus comprises an enclosure for receiving the ice chips and water together with a specially designed mixer comprised of a vertical shaft passing downwardly into the enclosure and terminating short of the bottom of the enclosure, and radially extending turbine blades secured to the shaft. These blades are so designed and positioned along the shaft and appropriately pitched such that rotation of the shaft in a given direction drives the ice and water mixture in the enclosure downwardly with a high degree of agitation sufficient to more completely pulverize the ice chips than has been possible heretofore, so that the resulting liquid ice can flow properly through application equipment and into areas where it is to be used, without requiring salt.

In combination with the foregoing is an impeller means and associated pipe for recirculating the ice and water mixture from the bottom to the top of the enclosure. The liquid ice to be used is drawn off from a branch pipe connected to the recirculating pipe.

BRIEF DESCRIPTION OF THE DRAWINGS

A better understanding of this invention will be had by referring to the accompanying drawings in which.

DETAILED DESCRIPTION OF THE INVENTION

Figure 1:
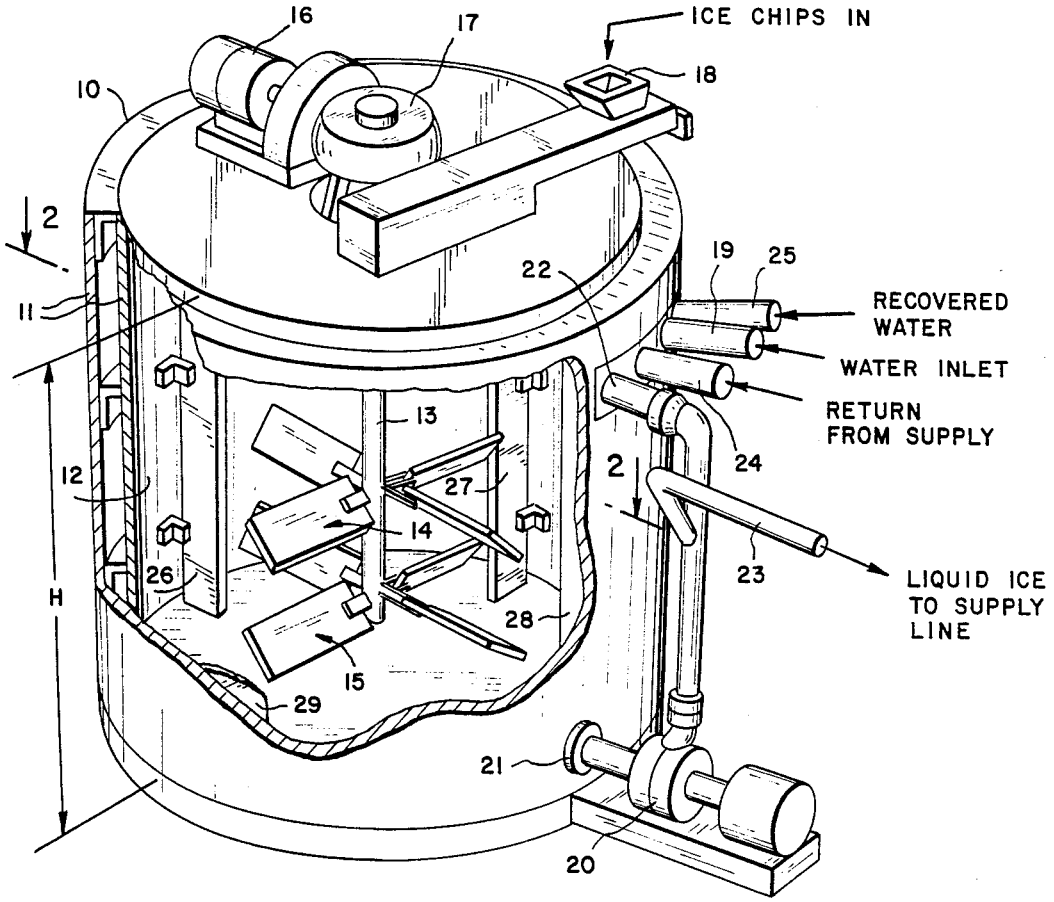
FIG. 1 is a broken away perspective view of the improved apparatus of this invention for providing salt-free liquid ice.

Referring first to the upper left corner of FIG. 1, there is shown an enclosure 10 preferably of cylindrical shape having a double side wall 11 for insulation purposes. The height indicated at H of the cylinder is approximately equal to the width or diameter of the cylinder. Because of the cylindrical shape in the preferred embodiment illustrated in FIG. 1, the inside wall indicated at 12 is smoothly rounded so that any interior side wall angles are avoided.

A drive shaft shown in the broken away portion at 13 extends vertically downwardly into the enclosure 10 and terminates short of the bottom of the enclosure. Two sets of turbine blades indicated generally at 14 and 15 are secured to the drive shaft 13 in axially spaced positions as shown. Each of the sets includes four turbine blades spaced at 90° from each other and pitched at 45°. These blades are caused to rotate as by a motor 16 and appropriate coupling 17, shown at the top of the enclosure 10 connecting to the upper end of the shaft 13. The direction of rotation is such that ice and water mixture in the enclosure will be driven downwardly by the various turbine blades making up the sets 13 and 14.

An appropriate means including a hopper 18 is provided for receiving and introducing ice chips into the top of the of the enclosure. Further, as shown on the top portion of the enclosure to the right in FIG. 1, there is provided a water inlet pipe 19 for introducing water into the enclosure.

In combination with the mixing action of the turbine blades, there is further provided an impeller pump means shown at 20 exterior of the enclosure and having lower and upper pipe connections 21 and 22 to the enclosure for pumping ice and water mixture out from the bottom of the enclosure and a portion thereof back into the top of the enclosure, to effect a recirculation. A branch pipe connection 23 between the impeller pump and its connection to the top of the enclosure is provided for extracting ice and water mixture not returned to the top for application in other areas as needed. Thus, the inlet pipe 21 has a larger cross sectional area than the return upper pipe 22 so that as the recirculation takes place, a portion is always available to be drawn off by the branch pipe 23.

As mentioned heretofore, a very useful application of liquid ice is in the cooling or refrigeration of vegetables after they have been brought in from the fields and are to be transported to retail outlets, either in cartons or in refrigerated vehicles. Thus, a probe could be provided to receive liquid ice tapped off from the branch pipe 23 and inject the same into vegetables contained within a carton. Excess liquid ice and water not used by the probe and which would continue to flow in the branch pipe 23 would be returned to the enclosure 10 and for this purpose, there is illustrated an inlet pipe 24 to receive such return.

It is also desirable, although not essential, to recover water from collection tanks disposed below a moving conveyor, for example, upon which vegetable cartons are placed for freezing by liquid ice application. This melted ice or water collected can also be returned to the tank for economy purposes, and towards this end there is provided a recovered water inlet indicated at 25 in FIG. 1.

In the preferred embodiment of the present invention, the enclosure 10 is provided with baffles, preferably in the form of four baffle plates running between the bottom and top of the cylinder adjacent to the inner wall of the cylinder and circumferentially spaced from each other by 90°. These baffle means are illustrated in FIG. 1 at 26, 27, 28 and 29 and lie in radial planes each of the planes being spaced from the interior wall of the cylinder to define a gap behind the plate. The various turbine blades making up the sets 14 and 15 in FIG. 1 terminate short of the baffle plates, but the presence of the baffle plates is such as to provide for a far greater agitation of the ice chips and water mixture than results in the absence of such blades. As a consequence of this greater agitation, there is no necessity, as pointed out heretofore to add salt to the liquid ice.

Figure 2:
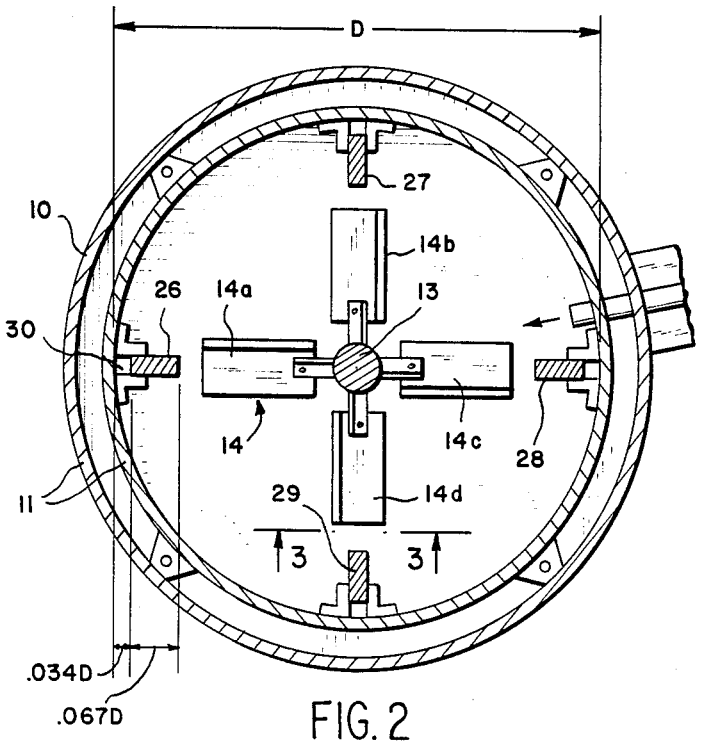
FIG. 2 is a plan cross section taken in the direction of the arrows 2—2 of FIG. 1.
Figure 3:
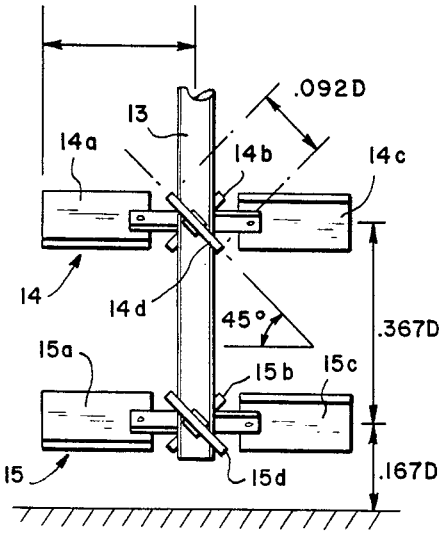
FIG. 3 is a side elevational view of a portion of the apparatus looking in the direction of the arrows 3—3 of FIG. 2.

Referring now to FIGS. 2 and 3, dimensional details of the enclosure and turbine blades briefly described in FIG. 1 will be evident.

Referring first to FIG. 2, the dimension D corresponds to the inside diameter of the cylindrical enclosure and is used as a unit to describe the relative dimensions of the other components. Thus, as already mentioned with respect to FIG. 1, the overall height H of the cylinder would be approximately equal to the diameter D. Other dimensions to be described with reference to the unit dimension D are to be understood as having a tolerance of plus or minus 10% of the specific values set forth.

Considering first the baffles identified by the same numerals in FIG. 2 as used in FIG. 1 at 26, 27, 28 and 29, each has a width of 0.067D and a height of D and the gap behind each baffle is 0.034D. The four turbine blades making up the two sets 14 and 15 described in FIG. 1 are individually designated 14*a*, 14*b*, 14*c* and 14*d* for the first set 14 shown in FIG. 2. The second set of four blades 15 are similarly individually designated 15*a*, 15*b*, 15*c* and 15*d* as can best be seen in the side view of FIG. 3.

Referring specifically to FIG. 3, the sets of turbine blades 14 and 15 are axially spaced along the shaft 13 by a distance of 0.367D. Each of the blades in turn, radially extends from the shaft a distance of 0.194D and has a width of 0.092D, such as indicated in FIG. 3 for the blade 14*a* and the blade 14*d* respectively. The lower set of blades 15 is spaced a distance of 0.167D from the floor of the enclosure as also indicated in FIG. 3.

In an actual embodiment of the invention, the dimension D could vary from 2 to 3 meters.

Figure 4:
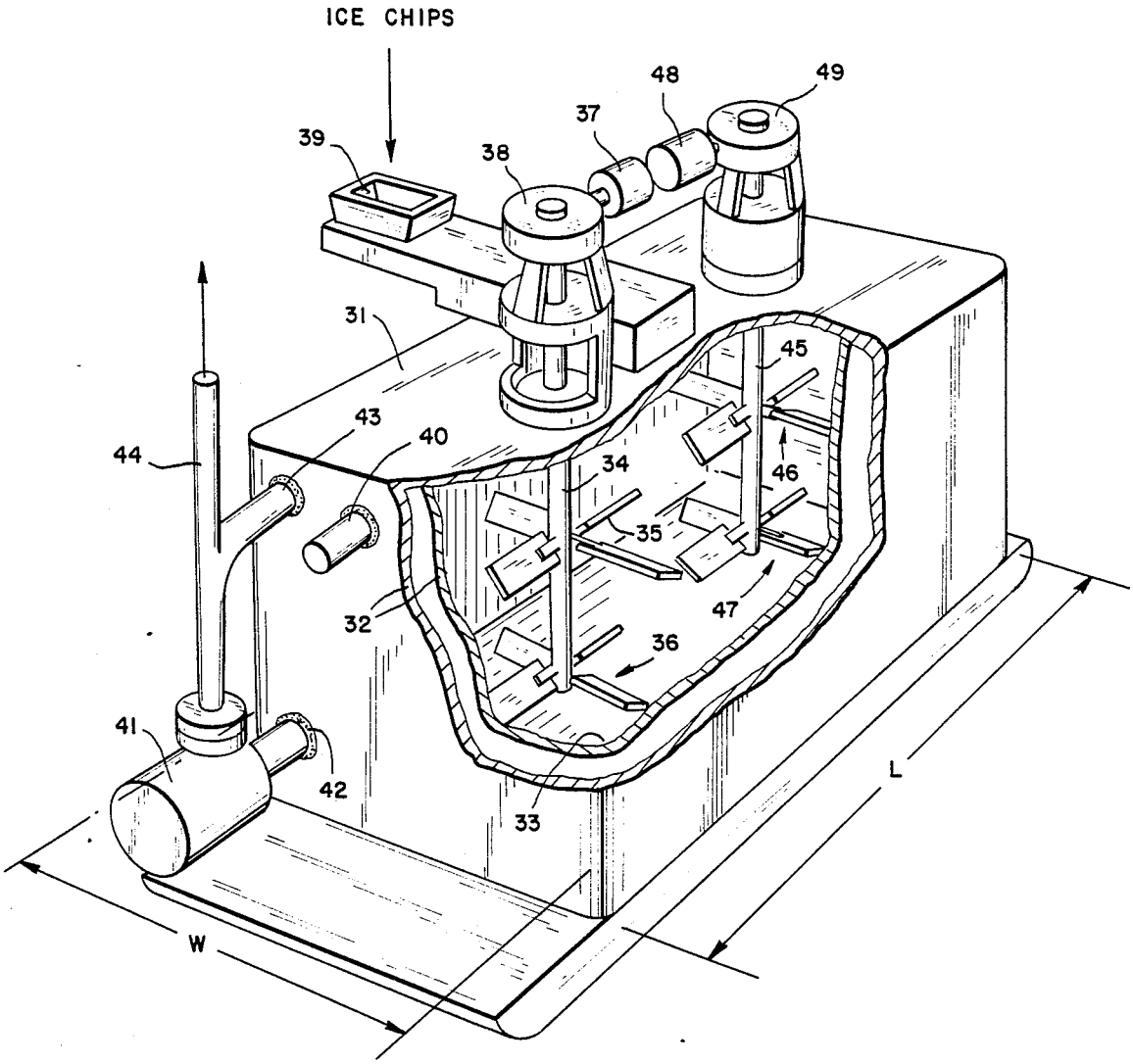
FIG. 4 is another broken away perspective view of a modified embodiment of the invention.

Referring now to FIG. 4, there is shown a modification of the present invention wherein certain features of this invention can be applied to the older conventional type of enclosure. Thus, in FIG. 4 the enclosure is shown at 31 and is in the shape of a parallelepiped having a length L approximately equal to twice its width W. The walls of the enclosure 31 as in the case of the cylindrical enclosure of FIG. 1 are double as illustrated at 32 for heat insulation purposes. The interior of the enclosure, while not cylindrical, nevertheless has smoothly rounded corners such as indicated at 33 in order to avoid any sharp angles on the interior wall.

A drive shaft 34 provided with first and second sets of four turbine blades each indicated at 35 and 36 extends vertically downwardly into the enclosure 31 terminating short of the floor thereof. Shaft 34 is driven by an appropriate motor 37 and drive coupling 38 disposed on the top of the enclosure 31.

Ice chips are introduced into the enclosure 10 by the hopper 39.

As in the case of the embodiment of FIG. 1, there is provided a water inlet shown at 40 on the top of the enclosure 31 to provide water to mix with the ice chips. Also there is included a recirculating impeller pump 41 having lower and upper pipe connections 42 and 43 to the lower and upper parts of the enclosure 31. A branch line 44 is provided to enable a drawing off of liquid ice being recirculated for application in other areas.

Because of the elongated shape of the enclosure 31, to provide for maximum efficiency in the manufacture of the liquid ice, there is provided an additional drive shaft shown at 45 carrying first and second sets of turbine blades 46 and 47. Shaft 45 is driven by a motor 48 through drive coupling 49 disposed on the top of the enclosure 31. Essentially, the first drive shaft 34 extends vertically downwardly in a central position in the first half of the parallelepiped shape while the second drive shaft 45 extends vertically downwardly in the second half of the parallelepiped shape. The dimensions and radial extent of the blades correspond substantially to those described in FIGS. 2 and 3 for the cylindrical enclosure, except that the unit of measurement would be the width W rather than the diameter D.

It has been found that by dimensioning carefully the turbine blades as described relative to the interior volume of the enclosure involved, liquid ice can be manufactured which is sufficiently "liquid" as to offer no resistance to passing through appropriate applicator devices. In other words, the liquid ice does not require lubrication as has characterized the liquid ice produced by conventional machines. Because such lubrication is not required, there is no need to add any salt to the liquid ice mixture and thus a salt-free liquid ice mixture is realizable.

The preferred embodiment of this invention is that set forth in FIGS. 1, 2 and 3. The FIG. 4 embodiment is illustrated merely to indicate that presently available enclosures can be modified to take advantage of the dimensional features of the present invention.

From all of the foregoing, it will now be evident that the present invention has provided a greatly improved liquid ice manufacturing apparatus having the distinctive feature of being capable of producing salt-free liquid ice.

I claim:

1. An apparatus for manufacturing salt-free liquid ice including, in combination:

(a) an enclosure in the form of a cylinder having double side walls for insulation purposes and a height approximately equal to its diameter, the interior of the enclosure including four baffle plates running between the bottom and top of the cylinder adjacent to the inner wall of the cylinder circumferentially spaced from each other by 90° and lying in radial planes, each plate being spaced from the interior wall of the cylinder to leave a gap behind the plate;

(b) a drive shaft passing vertically coaxially downwardly into said cylinder and terminating short of the bottom of the enclosure;

(c) two sets of turbine blades secured to said drive shaft in axially space positions, each of said sets including four turbine blades spaced at 90° to each other and pitched at 45°, the turbine blades extending a radial distance form said drive shaft terminating short of said baffle plates so that upon rotation of the shaft in a given direction, ice and water mixture in the enclosure is driven downwardly by the blades and pulverized by the baffle plates as the turbine blades rotate;

(d) means on the top of the enclosure for introducing ice chips;

(e) means on the upper side wall of the enclosure for introducing water;

(f) impeller pump means exterior of the enclosure having lower and upper pipe connections to the enclosure to pump ice and water mixture out from the bottom of the enclosure and a portion thereof back into the top of the enclosure to effect a recirculation; and (g) a branch pipe connection between the impeller pump and its connection to the top of the enclosure for extracting ice and water mixture not returned to the top for application in other areas as needed.

2. An apparatus according to claim 1, including a return inlet opening at the top of the enclosure for receiving any return ice and water from other areas at which the ice and water mixture has been applied form said branch pipe; and, an additional water inlet opening in the top of the enclosure for receiving any water recovered from collector tanks at an application station in other areas.

3. An apparatus according to claim 1, wherein if D is the diameter of said cylinder, the following dimensions within plus or minus 10% obtain: the baffles have a width of 0.067D and a height of D and the gap behind each baffle is 0.034D; the sets of turbine blades are axially separated by a distance of 0.367D, each blade radially extending from said shaft a distance of 0.194D and has a width of 0.092D; and, the lower set of blades is spaced 0.167D from the bottom of the cylinder.

4. An apparatus according to claim 3, in which D is from two to three meters.

* * * * *